US008037822B2

(12) United States Patent
Althof et al.

(10) Patent No.: US 8,037,822 B2
(45) Date of Patent: Oct. 18, 2011

(54) WARHEAD BOOSTER EXPLOSIVE LENS

(75) Inventors: A. Russ Althof, Tucson, AZ (US); William R. Hawkins, Abilene, TX (US); Henri Y. Kim, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/985,970

(22) Filed: Jan. 6, 2011

(65) Prior Publication Data

US 2011/0094405 A1 Apr. 28, 2011

Related U.S. Application Data

(63) Continuation of application No. 11/779,568, filed on Jul. 18, 2007, now Pat. No. 7,921,775.

(60) Provisional application No. 60/823,874, filed on Aug. 29, 2006.

(51) Int. Cl.
*F42C 11/00* (2006.01)

(52) U.S. Cl. ..... 102/202.14; 102/202.5

(58) Field of Classification Search ..... 102/202.5, 102/204, 476, 701, 275.9, 306, 309
See application file for complete search history.

(56) References Cited

U.S. PATENT DOCUMENTS

| | | | | | |
|---|---|---|---|---|---|
| 3,027,838 | A | * | 4/1962 | Meddick | 102/309 |
| 3,100,445 | A | * | 8/1963 | Poulter | 102/309 |
| 3,661,086 | A | * | 5/1972 | Thomanek et al. | 102/476 |
| 4,111,126 | A | * | 9/1978 | Thomanek | 102/476 |
| 4,665,826 | A | * | 5/1987 | Marer | 102/401 |
| 4,672,896 | A | * | 6/1987 | Precoul et al. | 102/309 |
| 4,711,177 | A | * | 12/1987 | Foster et al. | 102/204 |
| 4,729,318 | A | * | 3/1988 | Marsh | 102/308 |
| 4,920,883 | A | * | 5/1990 | Barker | 102/202.5 |
| 4,998,477 | A | * | 3/1991 | Barker | 102/275.6 |
| 5,052,301 | A | * | 10/1991 | Walker | 102/202.7 |
| 5,565,644 | A | * | 10/1996 | Chawla | 102/307 |
| 5,801,323 | A | * | 9/1998 | Kerdraon | 102/476 |
| 5,859,383 | A | * | 1/1999 | Davison et al. | 102/307 |

* cited by examiner

*Primary Examiner* — Michael Carone
*Assistant Examiner* — Jonathan C Weber
(74) *Attorney, Agent, or Firm* — Eric A. Gifford

(57) ABSTRACT

A cost-effective solution is proposed to improve explosive transfer between booster and warhead that is compatible with the existing base of general purpose warheads and flexible to work with new warhead configurations. A booster lens is placed in the fuze well that concentrates the pressure wave to penetrate the fuze well with a peak pressure that exceeds the detonation threshold and detonate the warhead explosive. The booster lens can be configured to control the direction of the concentrated lobe to penetrate the fuze well where the barriers are low.

17 Claims, 10 Drawing Sheets

WARHEAD BOOSTER EXPLOSIVE LENS

CROSS-REFERENCE TO RELATED APPLICATIONS

This application claims benefit of priority under 35 U.S.C. 120 as a continuation application of U.S. Nonprovisional application Ser. No. 11/779,568 entitled "Warhead Booster Explosive Lens" filed on Jul. 18, 2007, now U.S. Pat. No. 7,921,775, which claims the benefit of priority under 35 U.S.C. 119(e) to U.S. Provisional Application No. 60/823,874 entitled "Warhead Booster Explosive Lens" filed on Aug. 29, 2006, the entire contents of which are incorporated by reference.

BACKGROUND OF THE INVENTION

1. Field of the Invention

This invention relates to the explosive transfer between a booster and a warhead.

2. Description of the Related Art

The detonation of a warhead in a munition e.g., a missile, projectile, artillery shell, bomb, etc. is typically a multi-stage process to ensure both reliability and safety. It is important that the warhead detonate when triggered and not detonate accidentally due, for example, to mishandling or exposure to fire. The consequences of accidental detonation at a munitions depot or on-board a ship could be devastating. The explosive transfer between the booster and warhead can be a very challenging problem when trying to satisfy cost, interoperability, reliability and safety concerns.

As shown in FIGS. 1*a* and 1*b*, an exemplary munition 10 includes a warhead 12, a fuze 14 and a booster 16. Warhead 12 includes an external housing 18, a fuze well 20 formed from steel and lined with asphalt to provide insulation and protection from expansion/contraction, a charge tube fitting 22 for routing electrical cabling through the warhead to the fuze and explosive material 24 filling the warhead. In this particular embodiment, the fuze is not connected to electrical cabling through fitting 22 but the general purpose warhead includes the fitting nonetheless. Booster 16 includes an explosive pellet 26 that sits inside a housing 32. The booster is placed on top of the fuze, directly on top of the fuze's explosive pellet 34, and the assembly is inserted into the warhead's fuze well. A locking mechanism 36 secures the assembly.

To detonate the warhead, fuze 14 detonates its small explosive pellet 34, which transfers a pressure wave to the booster causing the booster explosive pellet 26 to detonate. Detonation of the booster generates a much larger pressure wave that is transferred to the warhead causing the warhead explosive 24 to detonate. In order to detonate the warhead explosive, the booster pressure wave that is transferred to the explosive material must exceed a characteristic 'detonation threshold' of the material. To address safety concerns, modern insensitive munitions (IM) compliant explosives are switching to explosive materials in the warhead that have a higher detonation threshold. The other factor that affects detonation transfer is the 'barrier' between the booster detonation and the warhead's explosive material. This barrier includes the steel fuze well and asphalt lining and the charge tube fitting that attenuate the pressure wave. The barrier also includes any airgap between the fuze well and explosive materials that will occur at low temperatures, which also attenuates the pressure wave. To ensure reliability, explosive transfer must be designed for the worst case conditions including thickness of the barriers and extreme cold.

FIGS. 2 and 3 depict a simulation of explosive transfer in which the warhead explosive failed to detonate because the booster pressure wave 40 (dynes/cm$^2$) that was transferred to the explosive material 24 did not exceed the detonation threshold 42. In the depicted warhead design, the detonation threshold occurs at approximately $4.55\times10^{10}$ dynes/cm$^2$. As shown, the pressure wave emanates fairly uniformly from the booster explosive pellet 26 outward through the fuze well and into the warhead explosive material except that the wave is heavily attenuated at 90° from the booster interface by the charge tube fitting 22. Standard techniques to improve explosive transfer reliability include increasing the explosive energy of the booster. However, in the depicted simulation a 50% increase in explosive energy was still not sufficient to detonate the warhead. Furthermore, increasing the booster explosive increases costs, increases the total amount of explosive in a depot or on-board ship and may not fit in the available space in the fuze well in general purpose warheads with standard fuzes. For both economic and reliability reasons, the military places considerable demands on using proven general purpose warhead designs and fuze interchangeably in many different weapons systems. Another known technique that was tried was to include a 'flyer plate' on top of the booster. Upon booster detonation, the flyer plate is blasted forward so that its momentum into the explosive material triggers detonation. Unfortunately the charge tube fittings in a general purpose warhead lie directly in the path of the flyer plate rendering it ineffective.

By raising the detonation threshold to address accidental detonation, modern IM compliant explosives have made the task of reliable explosive transfer between the booster and warhead more difficult. A cost-effective solution for improving explosive transfer that can be used with general purpose warheads and fuzes is needed.

SUMMARY OF THE INVENTION

The present invention provides a cost-effective solution to improve explosive transfer between booster and warhead that is compatible with the existing base of general purpose warheads and flexible to work with new warhead configurations.

This is accomplished by placing a booster lens in the fuze well that concentrates the pressure wave to penetrate the fuze well with a peak pressure that exceeds the detonation threshold and detonates the warhead explosive. The booster lens can be configured to control the direction of the concentrated lobe to penetrate the fuze well where the barriers are low. In an embodiment for a general purpose warhead, a radial lens re-directs a portion of the axial component of the booster detonation in the radial direction away from the charge tube fittings to penetrate and detonate the warhead explosive approximately radially from the lens. The radial lens is suitably positioned between the booster and the closed end of the fuze well and has an annular surface that forms an angle with the booster to re-direct the explosive force radially. In another embodiment, an axial lens re-directs a portion of the radial component of the booster detonation in the axial direction to penetrate and detonate the warhead explosive approximately axially from the lens. The axial lens is suitably positioned around the booster in the fuze well and has a parabolic shape. The booster-lens assembly may be designed to occupy no more space than a standard booster and yet produce higher peak pressure and a more reliable explosive transfer. As such, the booster-lens assembly is ideally suited for use with general purpose warheads and existing fuzes.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a cost-effective solution to improve explosive transfer between booster and warhead that is compatible with the existing base of general purpose warheads and flexible to work with new warhead configurations. A booster lens is placed in the fuze well that concentrates the pressure wave to penetrate the fuze well with a peak pressure that exceeds the detonation threshold and detonates the warhead explosive. The booster lens can be configured to control the direction of the concentrated lobe to penetrate the fuze well where the barriers are low.

Figure 1B:
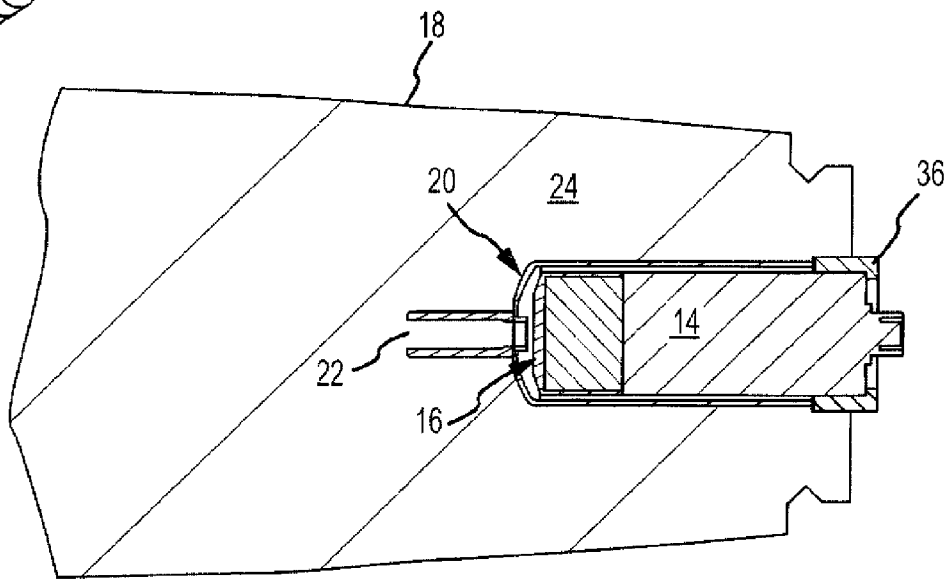
FIG.1b (PRIOR ART)
FIGS. 1*a* and 1*b*, as described above, are an exploded and section view of a warhead, booster and fuze assembly.
Figure 1A:
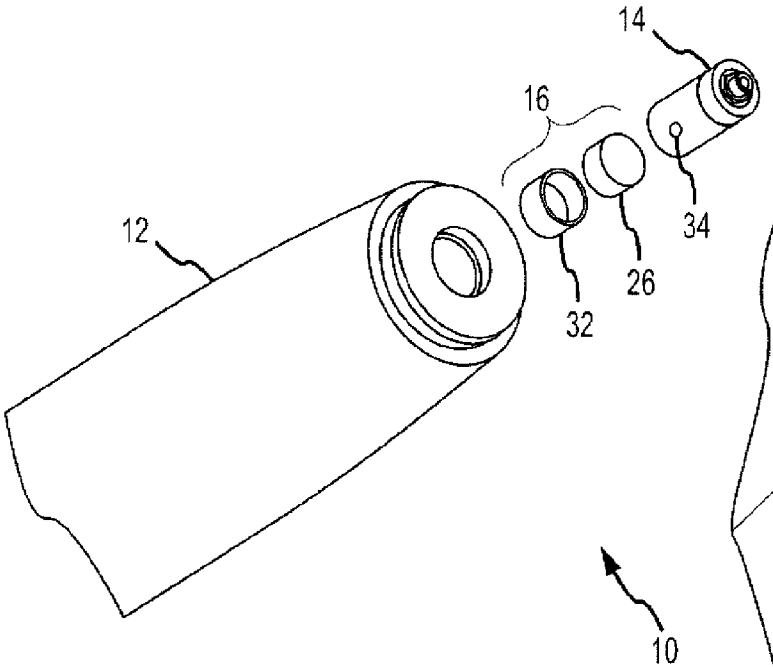
FIG.1a (PRIOR ART)
Figure 3:
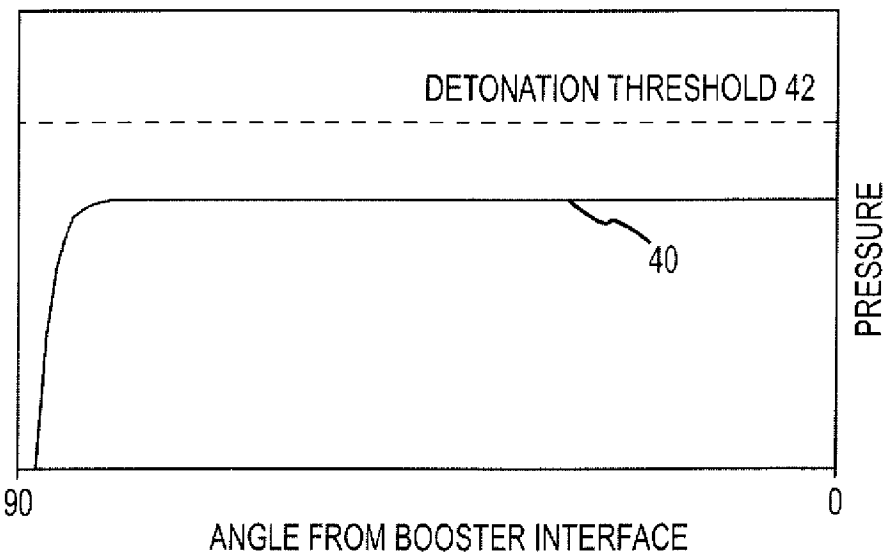
FIG.3 (PRIOR ART)
FIG. 3, as described above, is a plot of the pressure wave against the angle from the lens-booster interface.
Figure 2:
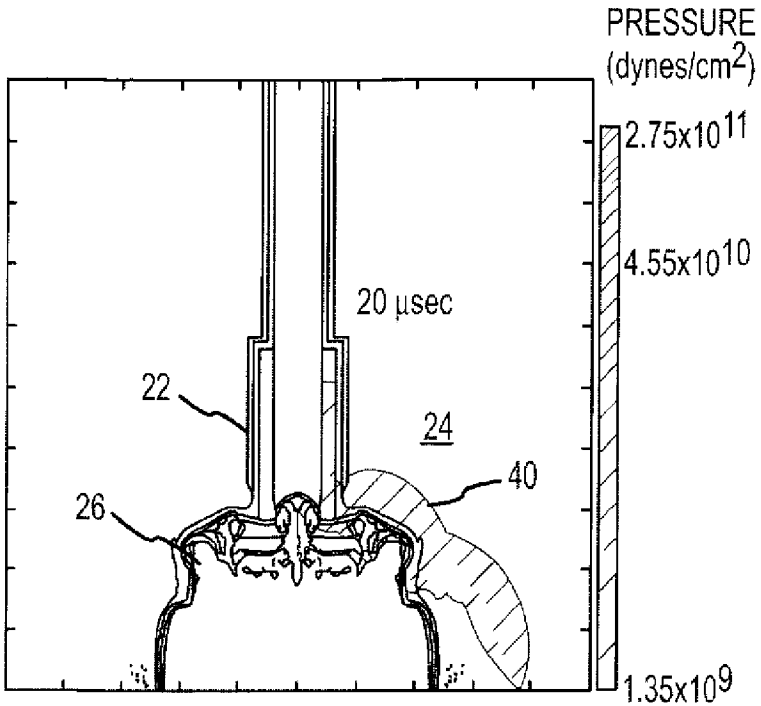
FIG.2 (PRIOR ART)
FIG. 2, as described above, is a diagram of the pressure wave of a simulated booster explosion that fails to detonate the warhead explosive.

To illustrate the ease with which the booster lens can be implemented with a general purpose warhead and standard fuze and the effectiveness of the lens, the invention will be described with reference to the munition 10 illustrated in FIGS. 1*a*-1*b*.

Like numbers will be used to describe like components. This particular embodiment is directed at a radial booster lens that re-directs a portion of the axial component of the booster explosion in the radial direction.

Figure 4B:
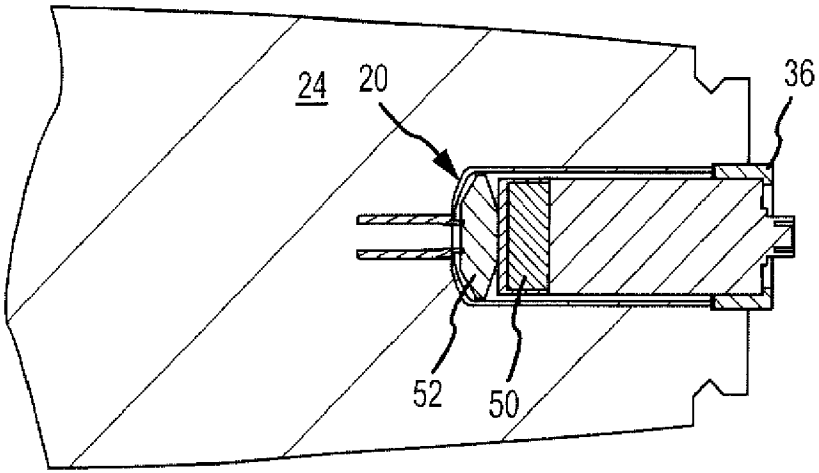
FIGS. 4*a* and 4*b* are an exploded and section view of a warhead, booster and fuze assembly including a booster lens for concentrating the pressure wave to detonate the warhead explosive.
Figure 4A:
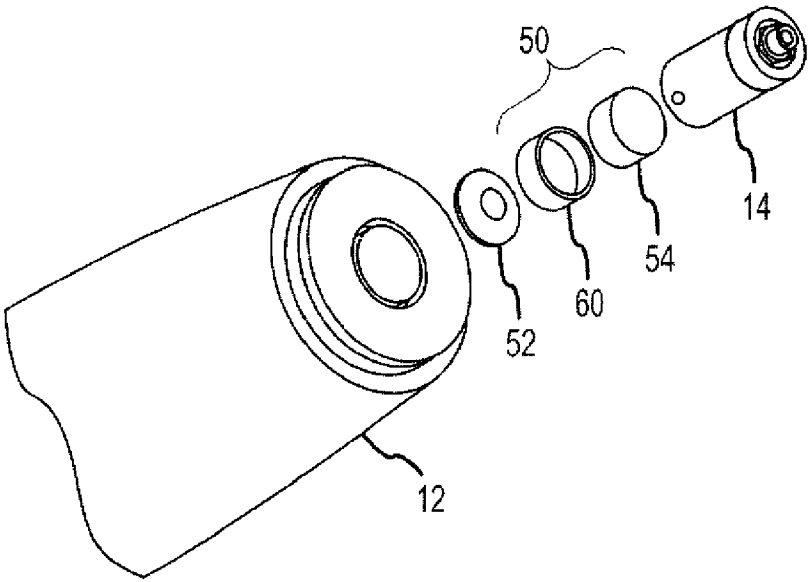

As shown in FIGS. 4*a* and 4*b*, booster 16 from the traditional fuze-booster assembly has been replaced with a booster 50 and booster lens 52. Booster 50 still suitably includes an explosive pellet 54 that sits inside a housing 60. In some configurations, for example when the booster is procurred or manufactured separate from the fuze, the pellet is placed inside a cup with a cover to avoid handling bare explosive, which in turn is placed inside the housing. To accommodate the addition of the booster lens, the size of the booster 50 and particularly the thickness of explosive pellet 54 are reduced. If the same explosive material is used, the total explosive energy released by the detonation of the booster will be less than for booster 16. However, the placement of booster lens 52 between the booster and the closed end of fuze well 20 sufficiently concentrates the energy, albeit lower in total, so that the peak pressure of the conentrated lobe is actually higher and sufficiently high to exceed the detonation threshold and detonate the warhead explosive 24.

Figure 5B:
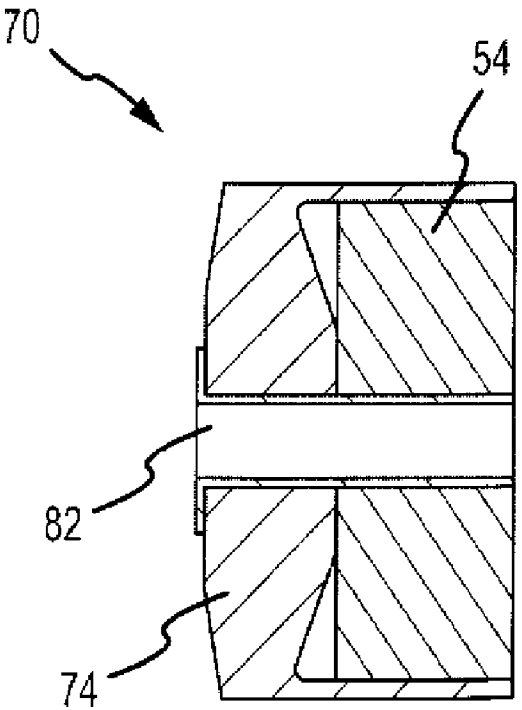
FIGS. 5*a* and 5*b* are diagrams of a standard booster of the prior art and an integrated booster-lens assembly of the present invention.
Figure 5A:
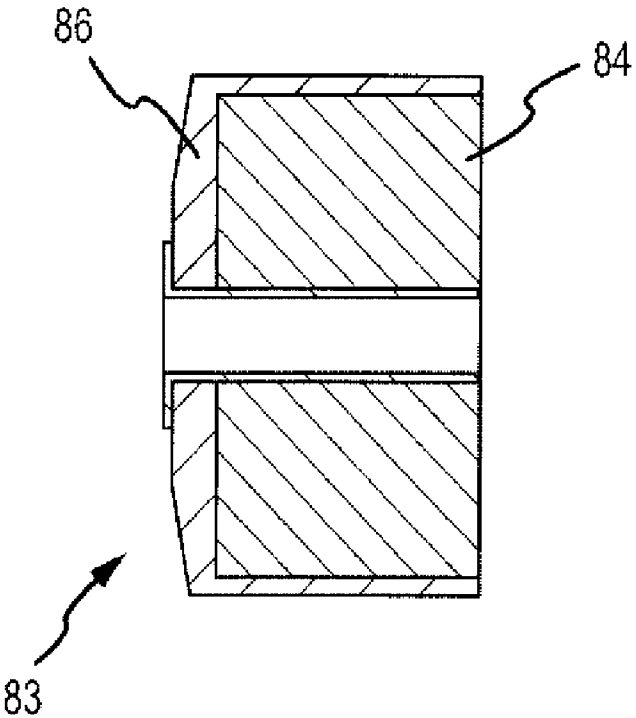
FIG.5a (PRIOR ART)

The booster and lens can be discrete components as shown above or they can be integrated into a booster-lens assembly 70 as shown in FIG. 5*b*. In this case, a housing 74 is made large enough to accommodate the explosive pellet 54 with the lens shape formed directly in the housing 74. In this embodiment, the booster-lens assembly is formed with an axial conduit 82 for routing the electrical cabling from the charge tube fittings to the fuze. In a standard booster 83 as shown in FIG. 5*a*, the explosive pellet 84 fits inside a housing 86. If the booster-lens assembly 70 is designed to replace a standard booster, the size of the housings may be the same. Although the standard booster will have a larger explosive pellet, hence greater total explosive energy, the combination of the lens with a smaller pellet concentrates the energy and thus provides a more reliable explosive transfer.

Figure 6:
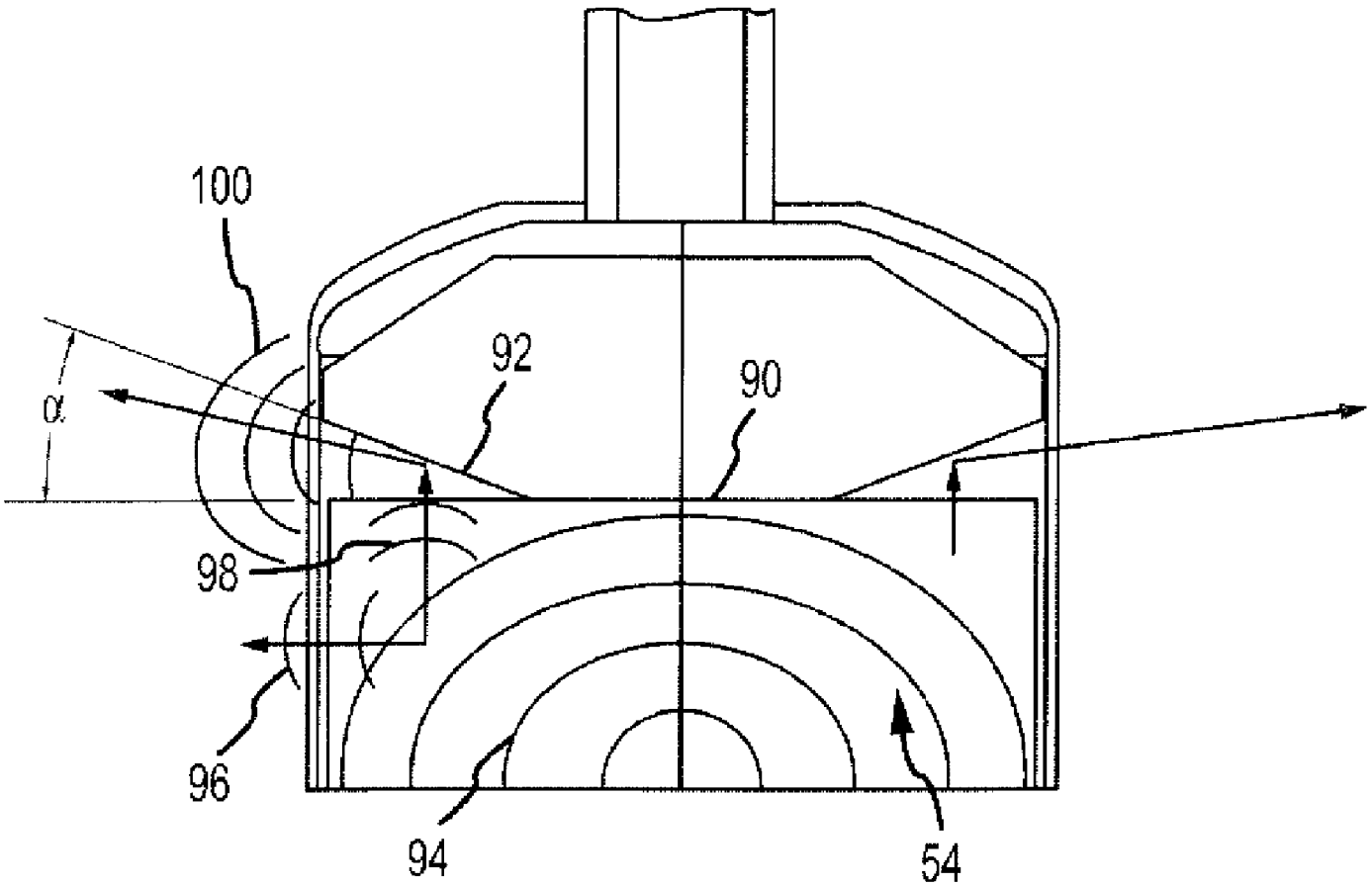
FIG. 6 is a diagram of the lens illustrating how the pressure wave is concentrated in the radial direction.

As shown in FIG. 6, in one embodiment booster lens 52 has a base surface 90 that suitably rests on top of the booster and an annular surface 92 that forms an acute non-zero angle with the top of the booster. The sides and top surfaces of the lens suitably conform to the closed end of the fuze well. Detonation of the booster's explosive pellet 54 generates a pressure wave 94 that has a radial component 96 and an axial component 98. A portion of axial component 98 is re-directed in the radial direction thereby concentrating more energy in a lobe 100 that travels approximately radially outward to penetrate the fuze well and detonate the warhead explosive. The lens is suitably formed from a material such as steel or aluminum that can absorb the booster detonation and re-direct the energy without being instantly destroyed. The width of base surface 90 and angle $\alpha$ of the annular surface 92 effect how much of the axial component is captured, how tightly the energy is concentrated in lobe 100 and in what direction lobe 100 is oriented. The angle and base width are suitably selected to capture a sizeable portion of the axial component and re-direct it into a concentrated lobe so that the peak pressure is sufficiently high for reliable explosive transfer. These parameters are constrained by both the available diameter and thickness of the lens in a particular booster-lens assembly and warhead design.

Figure 7A:
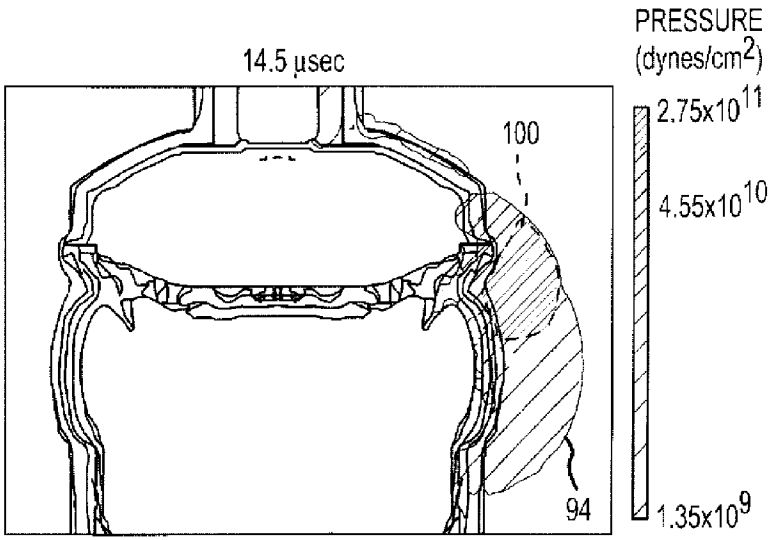
FIGS. 7*a* and 7*b* are time-elapsed diagrams of the pressure wave of a simulated booster explosion using the lens that achieves detonation transfer.
Figure 7B:
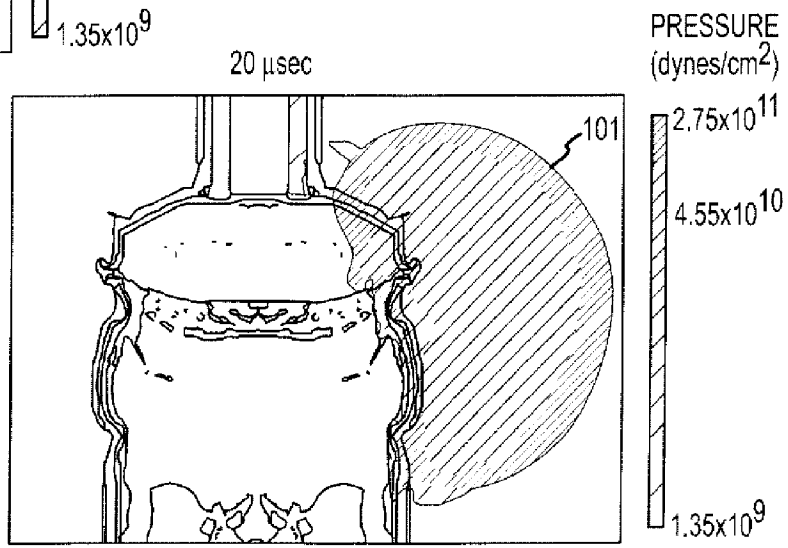
Figure 8:
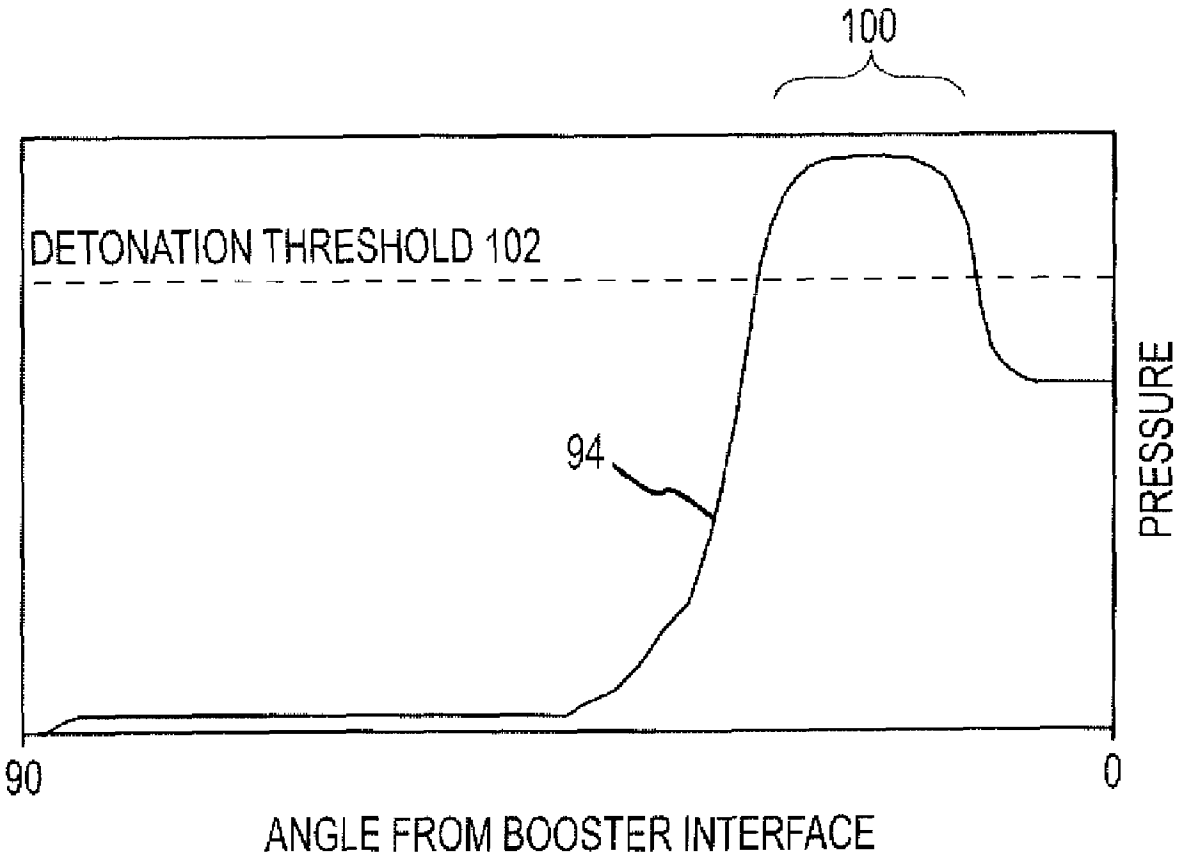
FIG. 8 is a plot of the pressure wave against the angle from the lens-booster interface for the radial lens.

FIGS. 7*a*-7*b* and 8 depict a simulation of explosive transfer using a booster-lens assembly in which the warhead explosive successfully detonated 101 because the peak pressure in lobe 100 of pressure wave 94 that was transferred to the explosive material exceeded the detonation threshold 102, approximately $4.55\times10^{10}$ dynes/cm$^2$ for this design. As shown, the pressure wave emanates in a narrow field of view from the booster explosive pellet outward through the fuze well and into the warhead explosive material. The wave is heavily concentrated in lobe 100 with a maximum pressure of approximately $2.75\times10^{11}$ dynes/cm$^2$ about 10-30° above the radial direction and is heavily attenuated with a minimum pressure of approximately $1.35\times10^{9}$ dynes/cm$^2$ elsewhere demonstrating that the lens effectively redirected the energy towards the radial direction. Although the total explosive energy may be a fraction, e.g. 50%, of the standard booster for the described general purpose warhead and fuze configuration, the peak pressure transferred to the explosive material is significantly higher and thus much more effective at producing a successful explosive transfer.

Figure 9:
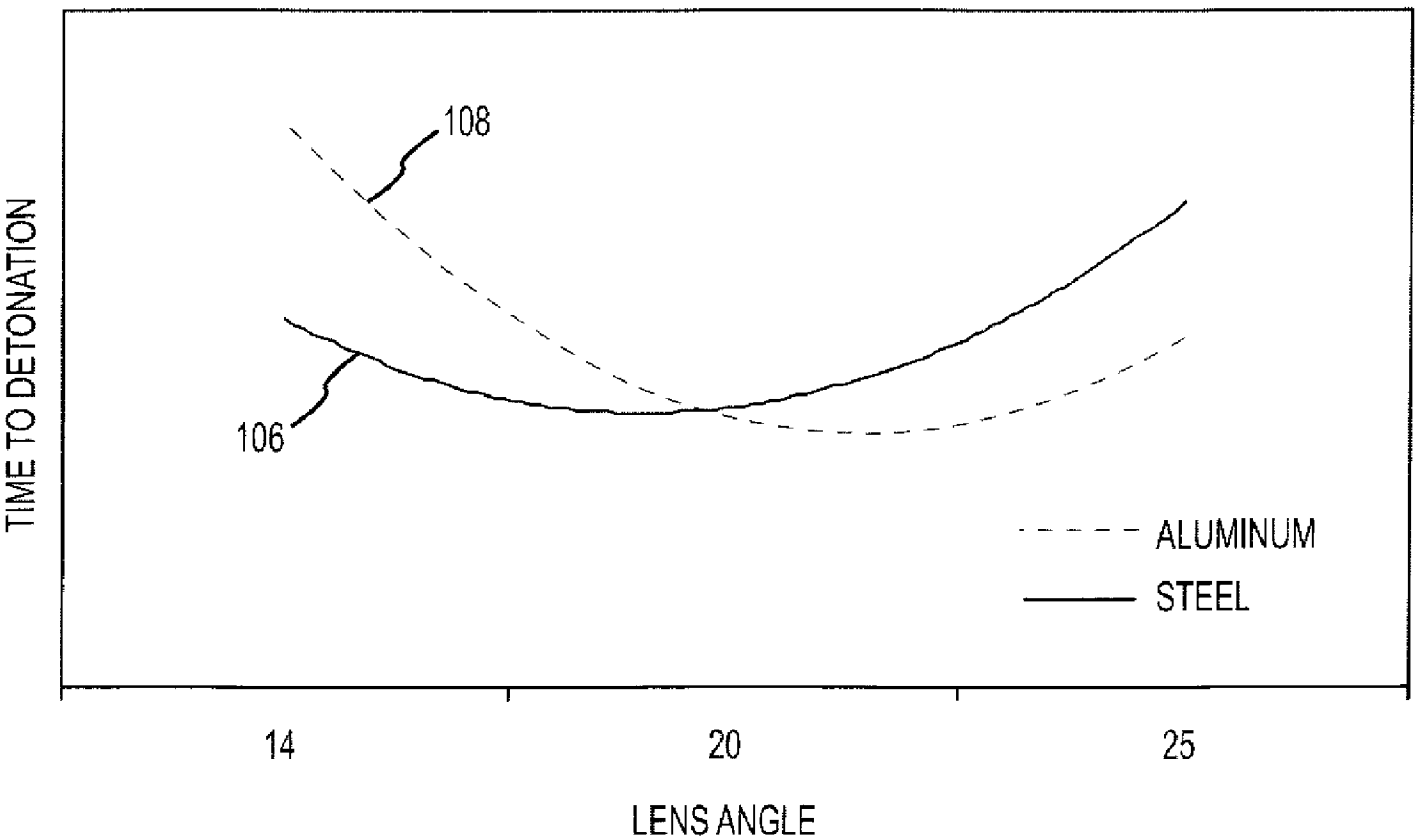
FIG. 9 is a plot of booster lens angle sensitivity.

The simulation was run for a range of lens angles and the time to detonation was plotted 106, 108 for both a steel lens and an aluminum lens as shown in FIG. 9. In both cases, explosive transfer was achieved in a few tens of microseconds over a range of at least 15-25 degrees. It can be extrapolated from these results that a very fast and successful detonation corresponds to a highly concentrated lobe with a high peak pressure. It is expected that successful detonation would be achieved for angles well outside this range. This particular simulation demonstrated that a 20° angle was a good choice for the general purpose warhead and standard fuze. The data suggests that an angle between approximately 10° and 30° would provide reliable explosive transfer for a general purpose warhead. Angles outside this range and different ranges of angles will be dictated by the design of the warhead, fuze and types and amounts of explosives used.

Although the booster-lens assembly of the current invention is particularly well-suited for use with the general purpose warhead and interchangeable fuze, it is not so limited. The principle of using the lens to concentrate and redirect the pressure to penetrate a portion of the fuze well having a low barrier can be extended to other existing or new warhead designs. The lens can be used to increase the reliability of explosive transfer for a given booster or can be used to provide reliable explosive transfer for a smaller booster. The booster-lens assembly can be configured to fit into a predefined space in the fuze well or configured for use in a new design that is not so constrained.

Figure 10:
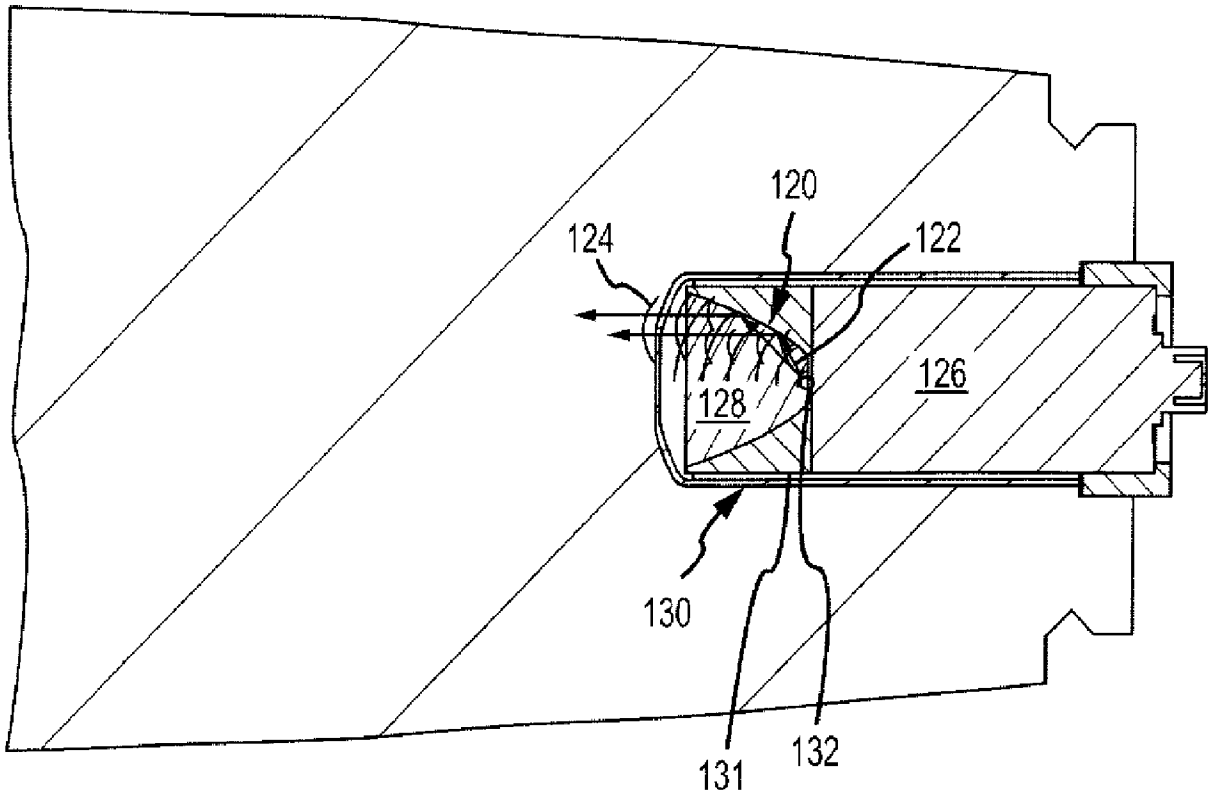
FIG. 10 is a section view of an alternate warhead design in which a parabolic lens is formed into the booster housing to concentrate the shock wave in the axial direction.
Figure 11:
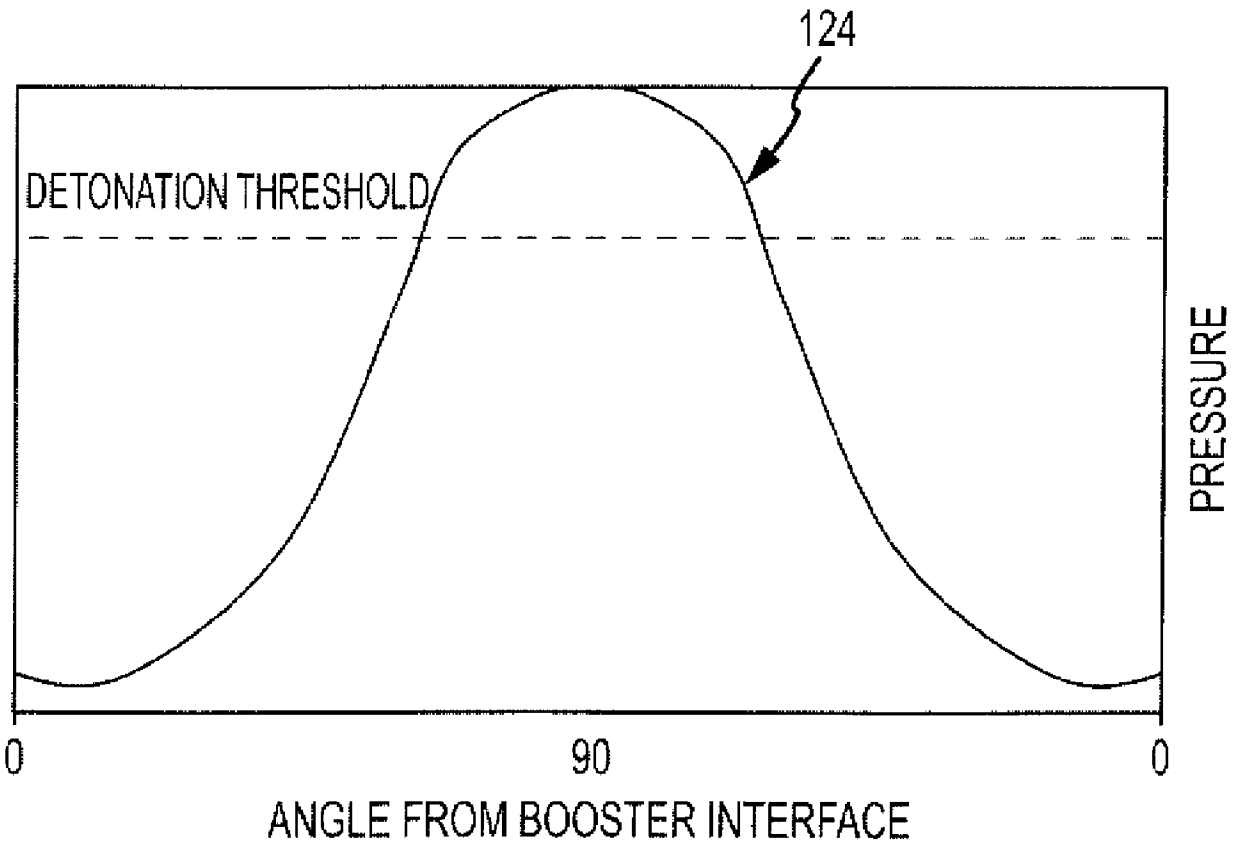
FIG. 11 is a plot of the pressure wave against the angle from the lens-booster interface for the parabolic lens.

As illustrated in FIGS. 10 and 11, an axial booster lens 120 re-directs a portion of the radial component 122 of the booster detonation in the axial direction to produce a concentrated axial lobe 124 that penetrates and detonates the warhead explosive approximately axially from the lens. The axial lens is suitably positioned at the end of fuze 126 around the booster explosive 128 in the fuze well 130 and preferably has a parabolic shape. The axial lens 120 is suitably formed into the walls of a housing 131 around the booster. The parabolic focus 132 at the initiation point is positioned at the bottom of lens 120 at the interface with the booster explosive 128. This configuration may be useful, for example, in a warhead that does not have the charge tube fittings positioned along the long axis of the warhead.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A munition, comprising:

a warhead including a fuze well and a warhead explosive around the fuze well;

a booster including a booster explosive placed inside the fuze well, said fuze well providing a physical barrier between the booster explosive and warhead explosive;

a fuze behind the booster inside the fuze well that detonates the booster explosive creating a pressure wave with a peak pressure that has a forward axial component and a radial component; and a radial booster lens positioned between the booster and a closed end of the fuze well, said radial booster lens having a surface configured to re-direct a portion of the forward axial component in the radial direction to concentrate more energy in a lobe with increased peak pressure that travels approximately radially outward to penetrate the physical barrier formed by the fuze well and directly detonate the warhead approximately radially from the booster lens.

2. The munition of claim 1, wherein the booster lens comprises:

a base surface that rests on only a central portion of a top surface of the booster;

an annular surface spaced apart from the top surface that forms an acute non-zero angle with the top surface of the booster so that the spacing between the booster top surface and the lens annular surface increases in the radial direction, said annular surface re-directing the portion of the forward axial component in the radial direction into the lobe; and a top surface that conforms to the closed end of the fuze well.

3. The munition of claim 1, wherein the warhead further comprises a charge tube fitting at the closed end of the fuze well that attenuates the forward axial component of the pressure wave.

4. The munition of claim 1, wherein said warhead and fuze are standardized components having a standardized fuze well length and fuze length, which define a length at the closed end of the fuze well for a booster to detonate the warhead explosive, said booster having less booster explosive such that said booster and said lens fit in the defined length and produce a concentrated pressure wave in the lobe having a peak pressure at least equal to that of the larger booster.

5. The munition of claim 1, wherein the booster further comprises a housing for the booster explosive, said lens being formed into said housing.

6. The munition of claim 1, wherein the radial booster lens is formed of a metal material.

7. The munition of claim 1, wherein the warhead explosive fills an external housing around the fuze well.

8. The munition of claim 1, wherein the fuze well is formed from metal and lined with asphalt.

9. The munition of claim 1, wherein the fuze well is cylindrically shaped.

10. A fuze assembly for use in a fuze well of a warhead including a warhead explosive around the fuze well, comprising:

a booster including a booster explosive placed inside the fuze well, said fuze well providing a physical barrier between the booster explosive and warhead explosive;

a fuze configured to detonate the booster explosive to create a pressure wave having a forward axial component and a radial component; and a booster lens having a surface configured to re-direct a portion of the forward axial component of the pressure wave off of the lens surface in the radial direction to concentrate the pressure wave into a lobe in the radial direction with increased peak pressure to penetrate the physical barrier formed by the fuze well and directly detonate the warhead approximately radially from the booster lens.

11. The fuze assembly of claim 10, wherein the peak pressure of the booster pressure wave does not exceed a pressure threshold to detonate the warhead explosive, said increased peak pressure of the lobe exceeding the pressure threshold to directly detonate the warhead explosive.

12. The fuze assembly of claim 10, wherein the booster lens comprises:

a base surface that rests on only a central portion of a top surface of the booster; and an annular surface spaced apart from the top surface that forms an acute non-zero angle with the top surface of the booster so that the spacing between the booster top surface and the lens annular surface increases in the radial direction, said annular surface re-directing the portion of the forward axial component in the radial direction into the lobe.

13. A munition, comprising:

a warhead including a fuze well and a warhead explosive around the fuze well;

a booster including a booster explosive placed inside the fuze well, said fuze well providing a physical barrier between the booster explosive and warhead explosive;

a fuze behind the booster inside the fuze well that detonates the booster explosive creating a pressure wave with a peak pressure; and a radial booster lens positioned between the booster and a closed end of the fuze well, said radial booster lens having a surface configured to re-direct and concentrate the pressure wave to penetrate the physical barrier formed by the fuze well and directly detonate the warhead approximately radially from the booster lens.

14. The munition of claim 13, wherein the radial booster lens is formed of a metal material.

15. The munition of claim 13, wherein the warhead explosive fills an external housing around the fuze well.

16. The munition of claim 13, wherein the fuze well is formed from metal and lined with asphalt.

17. The munition of claim 13, wherein the fuze well is cylindrically shaped.

* * * * *